US006090438A

United States Patent [19]

Dixon

[11] Patent Number: 6,090,438

[45] Date of Patent: Jul. 18, 2000

[54] METHOD OF APPLYING AN ATHLETIC MAT

[75] Inventor: Richard L. Dixon, Pittsburg, Kans.

[73] Assignee: Track Renovations and Coatings, Inc., Pittsburg, Kans.

[21] Appl. No.: 09/119,416

[22] Filed: Jul. 20, 1998

[51] Int. Cl.[7] ..... E01C 7/00; B05D 1/12; B05D 1/36

[52] U.S. Cl. ..... 427/203; 427/407.1; 401/31; 401/32; 401/82

[58] Field of Search ..... 427/202, 203, 427/407.1; 428/147, 428; 404/31, 32, 82; 156/278

[56] References Cited

U.S. PATENT DOCUMENTS

| | | | |
|---|---|---|---|
| 3,253,521 | 5/1966 | Endres . | |
| 3,446,122 | 5/1969 | Raichle et al. . | |
| 3,778,397 | 12/1973 | Gannon et al. . | |
| 3,891,585 | 6/1975 | McDonald . | |
| 3,993,412 | 11/1976 | Drane . | |
| 4,082,888 | 4/1978 | Portin . | |
| 4,341,836 | 7/1982 | Becker . | |
| 4,420,513 | 12/1983 | Coke et al. | 427/407.1 |
| 4,474,833 | 10/1984 | Maxfield . | |
| 4,529,622 | 7/1985 | Maxfield . | |
| 5,182,137 | 1/1993 | Allen . | |

*Primary Examiner*—Sam Chuan Yao
*Attorney, Agent, or Firm*—Hovey, Williams, Timmons & Collins

[57] ABSTRACT

A method of applying an athletic mat to a base surface comprises the steps of spreading a layer of rubber particles on the base surface. Although there may be some preparation (e.g., cleaning, material removal, etc.) of the base surface before the first layer of rubber particles is spread thereon, the first layer of rubber particles is applied without the necessity of a tack coating or primer layer. A first layer of binder is applied over the previously spread layer of rubber particles, with the binder having a viscosity to at least partially permeate through the layer of rubber particles. Accordingly, the first layer of rubber particles is bonded to the underlying surface when the first layer of binder dries. A separate, second layer of binder is applied over the first layer of binder preferably while the latter is still wet. A layer of particles is spread on the preceding layers immediately after the second layer of binder is applied so that at least some of the rubber particles in the layer bond to the preceding layers as the second layer of binder dries.

13 Claims, 2 Drawing Sheets

METHOD OF APPLYING AN ATHLETIC MAT

BACKGROUND OF THE INVENTION

1. Field of the Invention

The present invention relates to athletic mats such as outdoor tracks. More particularly, the present invention concerns an improved method of applying a rubberized athletic mat on a base surface.

2. Discussion of Prior Art

The popularity of rubberized athletic mats (i.e., mats comprising rubber particles bonded to one another by a suitable material) may be attributed to various factors. For example, rubberized athletic mats are resilient and therefore provide relatively greater cushioning than other types of surfaces (e.g., asphalt, cinder, dirt or turf). Rubberized athletic mats also provide athletes with relatively greater traction, especially in wet conditions, than other surfaces. In addition, most outdoor rubberized athletic mats have a sufficient number of interstices between the bound rubber particles to allow water to drain through the mat rather than accumulate on the top surface thereof.

However, conventional methods of constructing rubberized mats tend to be expensive and time consuming. Moreover, the mats constructed by conventional methods tend to have durability and maintenance problems.

For example, it is desirable to bond the mat to the underlying surface for preventing untoward stresses and wear on the mat. Consequently, traditional installation methods require application of a so-called "tack coating" or "primer layer" directly to the underlying surface before the layer or layers of rubber particles are spread on the surface. The tack coating or primer layer serves to adhere the mat to the underlying surface. However, this inherently requires an additional step in the installation method and additional materials and cost.

It is also known to construct rubberized mats from sequentially applied, alternating layers of binder material and particulate rubber. In some cases, the binder layer is allowed to dry before the subsequent layer of rubber particles is spread on top of the binder. This is inherently problematic because the subsequent layer of rubber particles is less likely to bond to the preceding layers. There have been attempts to solve this problem by spreading the rubber particles on the preceding layer of binder, while the binder is still wet so that the particles settle into the binder and bond to the preceding layers. However, this approach has heretofore prevented equipment and installers from contacting the mat during its construction. Particularly, when the binder is applied to a preceding layer of rubber particles, contact with the mat must be avoided; otherwise, the single layer of wet binder will likely cause loose particles from the preceding layer to bond to the object contacting the incomplete mat. For example, if a worker steps on the single layer of wet binder, rubber particles from the preceding layer will adhere to his/her footwear. Assuming the preceding layer of rubber particles has been spread uniformly on the underlying layers, removal of particles from the preceding layer will cause voids which must be filled or the top surface of the mat will likely have an uneven contour. Because the workers and equipment must essentially avoid all contact with the single layer of wet binder, their ability to apply the subsequent layer of rubber particles, while the binder is wet, is severely limited. That is, the area, on which the rubber particles are spread, must be sufficiently small so that the particles can be spread uniformly without contacting the wet binder.

OBJECTS AND SUMMARY OF THE INVENTION

Responsive to these and other problems, an important object of the present invention is to provide a method of applying a rubberized athletic mat to a base surface, wherein the inventive method is relatively less expensive and time consuming than conventional methods. It is also an important object of the present invention to provide a method that yields a rubberized athletic mat having all of the desired characteristics noted above, such as durability, cushioned support, and improved traction and drainage. Another important object of the present invention is to provide a method of applying a multi-layer rubberized mat, with the layers of rubber particles being securely bonded to one another. In particular, an important object of the present invention is to provide a method including the step of spreading each subsequent layer of rubber particles onto a preceding layer of binder, while the binder is still wet. However, it is an important object of the present invention to provide such a method without requiring the workers and equipment to avoid contact with the preceding layer of binder during application of the rubber particles.

In accordance with these and other objects evident from the following description of the preferred embodiment, the method of applying the athletic mat comprises the steps of spreading a layer of rubber particles on the base surface. Although there may be some preparation (e.g., cleaning, material removal, etc.) of the base surface before the first layer of rubber particles is spread thereon, the first layer of rubber particles is applied without the necessity of a tack coating or primer layer. That is not to say, however, that the first layer of rubber particles is not adhered to the base surface. Rather a first layer of binder is applied over the previously spread layer of rubber particles, with the binder having a viscosity to at least partially permeate through the layer of rubber particles. Accordingly, the first layer of rubber particles is bonded to the underlying surface when the first layer of binder dries. A second layer of binder is applied over the first layer of binder, with the first and second layers of binder being applied in sufficient quantity to cooperatively coat substantially all of the previously spread layer of rubber particles. A layer of particles is spread on the preceding layers immediately after the second layer of binder is applied so that at least some of the rubber particles in the layer bond to the preceding layers as the second layer of binder dries.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

Figure 4:
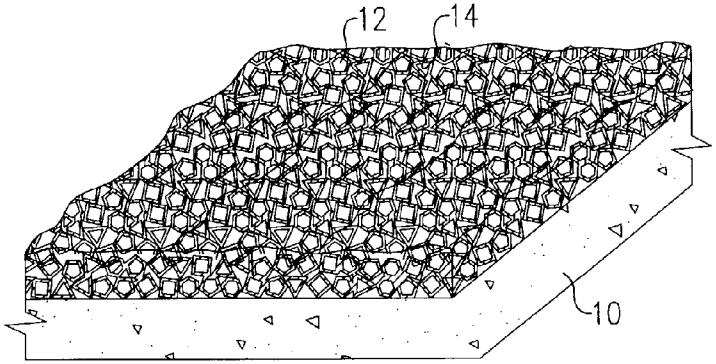
FIG. 4 is a fragmentary perspective view similar to FIGS. 2 and 3, but illustrating the condition of the mat after the first layer of binder has been applied.
Figures 5, 6:
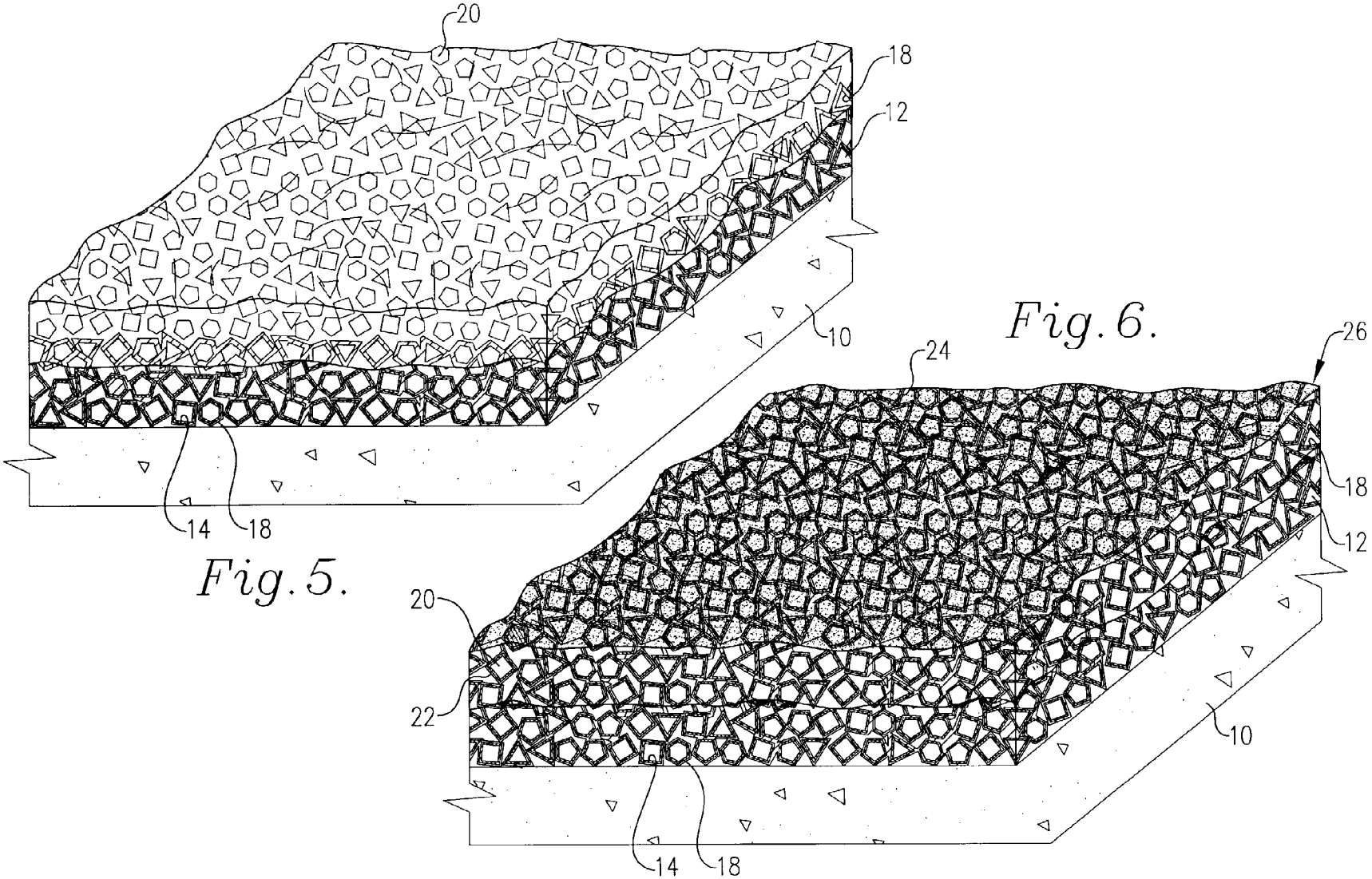

FIG. 5 is a enlarged, fragmentary perspective view similar to FIG. 4, but illustrating the condition of the mat after application of a second layer of binder followed immediately by a second layer of rubber particles, with the lowermost particles of the second rubber particle layer bonding to the preceding layers as the second layer of binder dries; and FIG. 6 is an enlarged, fragmentary perspective view of a completed athletic mat applied to the base surface in accordance with the principles of the present invention.

DETAILED DESCRIPTION OF THE PREFERRED EMBODIMENT

Figure 1:
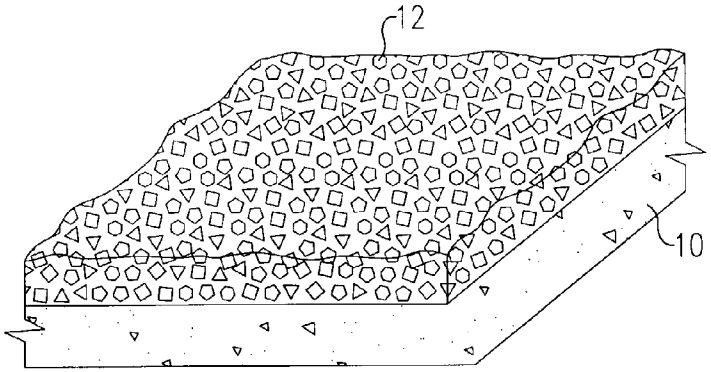
FIG. 1 is a fragmentary perspective of a base surface, with a layer of rubber particles having been uniformly spread on the surface.

Turning initially to FIG. 1, the present invention concerns a method of applying an athletic mat to a base surface 10. In the illustrated embodiment, the base surface 10 comprises a layer of asphalt, although it is entirely within the ambit of the present invention to utilize various other base surfaces. For example, the base surface may alternatively comprise concrete, dirt, cinder, wood or some other suitable foundation. In addition, the base surface 10 may be newly formed in preparation for the athletic mat or merely be a preexisting foundation.

In any case, the initial step of the preferred method involves spreading rubber particles into a substantially uniform layer 12 on the base surface 10 (see FIG. 1). The rubber particles may take a variety of forms, including rubber chips or buffings, strand rubber, etc. Particularly, the preferred rubber particles comprise one to three millimeter granules reclaimed from used tires. Various sources of the preferred rubber particles include Northwest Rubber Colorado, Inc. of Louviers, Colo.; Spartan Enterprises of Barberton, Ohio; and R.S.M.I. of Canton, Ohio. The rubber particles are preferably applied at a rate of approximately two pounds per square yard of base surface 10.

Such application may be accomplished by first depositing a mass of particles on the base surface 10 and then manually spreading the particles with a suitable tool (e.g., a trowel). However, the preferred method involves the use of a self-propelled vehicle (not shown) having a spreader (also not shown) which uniformly deposits the rubber particles as the vehicle is driven across the base surface 10. A suitable vehicle and spreader are available from Ransomes America Corporation of Lincoln, Nebr. under the respective trademarks "TURF-TRUCKSTER" and "CUSHMAN TD 1500 MOUNTED TOP DRESSER" (Model No. 892013). It will be appreciated that the preferred vehicle is effective in distributing its weight and the load carried thereon so as to avoid creating tracks in the underlying surface. In addition, the preferred spreader is particularly useful in uniformly applying the preferred rubber particles, although it is desirable to modify the spreader to increase its hopper capacity. In any event, the rubber particles are preferably spread at a rate of two pounds per square yard. When using the preferred rubber particles and at the preferred rate of application, the layer 12 has sufficient interstices and voids between the particles to allow a subsequent layer of binder to permeate the layer 12, as will subsequently be described.

It will be appreciated that the application of the rubber particle layer 12 may not be the first step in applying the athletic mat to the base surface 10. In some instances, the base surface 10 must be prepared prior to spreading the rubber particles thereon. For example, it is desirable that the base surface 10 be devoid of trash and debris before the mat is applied thereto. Accordingly, it may be necessary to clean the base surface before the rubber particle layer 12 is applied. Cleaning of the base surface 10 may be accomplished by any suitable expedient (e.g., sweeping, spraying with a pressurized cleaning agent, such as water, etc.). In addition, it may be desirable in some cases to a abrade the base surface 10 with a suitable scraper before the athletic mat is applied thereon.

Once the rubber particle layer 12 is spread on the base surface 10, a first binder layer 14 is uniformly applied over the rubber particle layer 12. In the illustrated embodiment, the binder is applied with hand held spray wands 16 (see FIGS. 2 and 3) connected to a pressurized source of binder (not shown). One suitable device for providing a pressurized source of binder includes a five-hundred gallon tank and a pump for pumping binder from the tank to the spray wands 16, with both the tank and pump being mounted to a trailer that is pulled alongside or on the base surface 10 by a towing vehicle. The first binder layer 14 preferably has a viscosity and is applied in sufficient quantity to permeate the rubber particle layer 12. Accordingly, the first binder layer 14 serves to bond the rubber particles of the first layer 12 to the base surface 10 as the former dries. Contrary to conventional application methods, the present invention does not require that a tack coating or primer layer be first applied to the base surface for adhering the remaining layers of the mat to the surface. By eliminating this step, the present invention saves cost and time in comparison to conventional methods.

The preferred binder comprises a latex-based solution diluted with water, with the binder consequently drying as the water evaporates. The dilution ratio depends upon the ambient conditions, although it is preferred that the first binder layer be applied at a rate of one-ninth gallon of undiluted latex-based solution per square yard of base surface. Typically, the latex-based solution and water are mixed at a ratio between 1:1 and 2:1 (latex-based solution:water), inclusive. A suitable latex-based solution is available from California Products Corporation of Cambridge, Mass. under the trademark "PLEXITRAC". If desired, the binder may further include fillers, such as synthetic fibers, rubber granules (0.5 mm–1.5 mm), wood pulp fibers, etc. Such a binder material would require that an agitator be placed in the five-hundred gallon tank to maintain the desired homogeneousness of the binder material.

Figure 2:
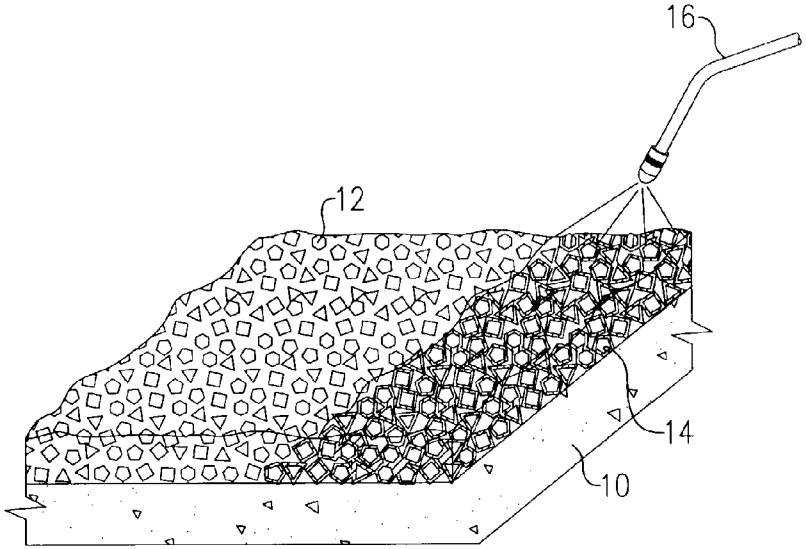
FIG. 2 is a fragmentary perspective view similar to FIG. 1, but illustrating a somewhat schematic depiction of a binder being sprayed over an area of the rubber particle layer.
Figure 3:
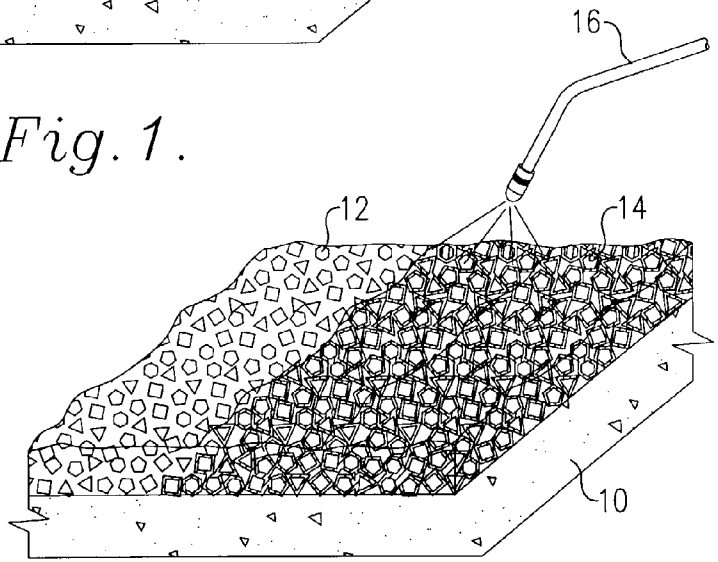
FIG. 3 is a fragmentary perspective view similar to FIG. 2, but illustrating the binder being sprayed over a second area of the rubber particle layer adjacent the first.

It is preferred that the first binder layer 16 not dry completely before the subsequent layer is applied thereto. As noted above, drying of the first binder layer 16 may be controlled to some extent by the dilution ratio. It has also been determined that the risk of drying of the first binder layer 14 may be reduced by sectioning the rubber particle layer 12 into substantially equal areas and then spraying, in sequence, the first binder layer 16 on the areas. For example, when an outdoor track (not shown) is being constructed, the rubber particle layer 14 is sectioned into approximately five to six feet wide, oval-shaped areas extending along the length of the track. This sequence is depicted in FIGS. 2–4, with FIG. 2 illustrating the binder being sprayed on a first area, FIG. 3 illustrating the binder being sprayed on an adjacent second area, and FIG. 4 illustrating the condition of the mat once the binder has been applied to a final third area. The binder is sprayed in a "feathering" manner similar to that used when painting an automobile, and consequently, there may be some overlapping of binder along adjacent areas.

For example, in a four hundred meter outdoor track installation on a day having ambient conditions of seventy degrees Fahrenheit and fifty percent humidity, the binder in the first layer 14 would preferably have a dilution ratio of two:one latex-based solution to water. It is believed that these conditions would result in the first binder layer 14 still being wet when the subsequent layer is applied, although some of the water in the first binder layer 14 would have evaporated and therefore some drying would have occurred.

Once the first binder layer 14 has been applied over the rubber particle layer 12, as illustrated in FIG. 4, a second binder layer 18 (see FIG. 5) is applied over the preceding layers. The binder used in the second layer 18 is preferably the same latex-based solution diluted to the same degree as the first layer 14. In addition, the second binder layer 18 is applied at the same rate and, assuming the first binder layer 14 was applied in sequence to sections of the rubber particle layer 12, in the same sequence as the first binder layer 14. With the preferred rubber particles and application rate of the first and second binder layers 14,18, the second binder layer 18 cooperates with the first binder layer 14 to coat substantially all of the rubber particles of the layer 12, without clogging the desirable interstices and spaces between particles. It will be appreciated that application of the second binder layer 18 over the first binder layer 14, before the latter has an opportunity to dry, improves the bond therebetween.

Immediately after the second binder layer 18 is applied, rubber particles are uniformly spread on the preceding layers 12,14,18 into a layer 20 (see FIG. 5), while the second binder layer 18 is still wet. The rubber particles in the second layer 18 are preferably the same as those used in the first layer 12. If the second binder layer 18 was sequentially applied to equal areas, then rubber particles spread on each area after the second binder layer 18 has been applied over that area and before the binder is applied on a subsequent area. For example, during installation of an outdoor track, the second binder layer 18 is preferably sprayed along a five to six feet wide, oval-shaped area of the track, with the rubber particle layer 20 being deposited along the track immediately after the second binder layer 20. The second binder layer 18 is then applied to a second five to six feet wide, oval-shaped area, followed immediately by the application of the rubber particle layer 20. This sequence continues until the second binder layer 18 and rubber particle layer 20 have been applied to the entire track.

The present invention obviously improves the cohesion between the rubber particle layers 12 and 20. In particular, at least some, if not all, of the particles in the layer 20 settle into the wet second binder layer 18 (and possibly the first binder layer 14 if it is still wet). These particles consequently bond to the preceding layers 12,14,18 as the binder dries. Moreover, the application of two separate binder layers 14,18 essentially eliminates the risk of removal of rubber particles from the layer 12. That is to say, the binder provides enough adhesion to the rubber particle layer 12 that workers and equipment may contact the mat, without rubber particles adhering to the footwear of the workers or the equipment. It is not entirely known as to why this advantage is gained by applying two separate binder layers over a layer of rubber particles. However, it is believed that this advantage is at least partially attributable to the fact that the first binder layer 14 has an opportunity to dry to some extent before the subsequent binder layer 18 is sprayed thereon. It may also be attributable to the fact that the binder layers 14,18 cooperatively coat substantially all of the rubber particle layer 12, such that there are no "loose" particles. In any case, this sequence provides the benefits of applying a layer of rubber particles onto a layer of wet binder, without experiencing the problem of rubber particle removal associated with conventional methods.

In this respect, the second binder layer 18 is preferably applied with the spray wands 16, with the workers being permitted to stand and walk directly on the preceding layers 12,14. In addition, the trailer supporting the pressurized source of binder and the vehicle towing the trailer may be driven directly onto the layer of rubber particles 12 and the first binder layer 14. Immediately following the workers is the preferred spreader vehicle, which may also be driven across the preceding layers 12,14,18. Because the present invention permits workers and equipment to contact the athletic mat during its construction, the time and expense in constructing the mat is significantly less than conventional methods.

Although the illustrated method includes only two rubber particle layers 12,20, it will be appreciated that the steps of applying a first layer of binder followed by virtually simultaneous application of a second binder layer and rubber particle layer may be repeated until a desired mat thickness is achieved. Continuing this sequence ensures not only that the subsequent layer of rubber particles is applied to a layer(s) of wet binder, but that the risk of removal of rubber particles from the preceding layer is virtually eliminated.

In any event, a final binder layer 22 (see FIG. 6) is preferably applied over the uppermost layer of rubber particles (rubber particle layer 20 in the illustrated embodiment). The final binder layer 22 is preferably applied after the previous binder layer 18 has dried and cooperates therewith to coat substantially all of the rubber particle layer 20. In addition, the final binder layer 22 comprises the same material (assuming the ambient conditions have not changed) applied at the same rate as each of the previous binder layers 14,18. It will be noted that the final binder layer 22 may be applied in one pass over the entire base surface 10, rather than sectioning the surface into equal areas and sequentially applying the final binder layer 22 to the areas. The spray wands 16 are preferably used in spraying the final binder layer 22 over the preceding layers 12,14, 18,20. In some instances, it may be desirable to leave a loose layer of rubber particles on the top surface of the mat, in which case the illustrated installation may be complete after application of the second rubber particle layer 20 and without application of the final binder layer 22.

The preferred method also includes application of a protective coating 24 over the final binder layer 22. The protective coating 24 may be pigmented to color the mat and preferably includes ultraviolet inhibiters to protect the underlying layers. A suitable coating is available from California Products Corporation of Cambridge, Mass. under the trademark "PLEXITRAC COATING". Preferably, the coating is applied in two separate coats at a total coverage rate of one-tenth gallon of undiluted coating material per square yard. The coats may be applied using conventional rollers or sprayers. It has also been determined that standard paints having ultraviolet inhibiters may alternatively be used as a protective coating.

As perhaps best depicted in FIG. 6, the foregoing method yields a durable athletic mat 26 having a uniform consistency and an even top surface. The mat 26 is adhered to the base surface 10, without the use of a tack coating or primer layer. In addition, the rubber particle layers 12,20 of the mat 26 are securely bonded to one another, without requiring the workers and equipment to avoid contact with mat 26 during its construction.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the size of the base surface may require the athletic mat to be applied in sections, with the foregoing steps being carried out for each section before another section is installed. In addition, it is within the principles of the present invention to permit the first binder layer 14 to dry completely (i.e., until no fluid is visible) before the second binder layer 18 is applied.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of applying an athletic mat to a base surface comprising the steps of:

(a) spreading a layer of rubber particles on the base surface;

(b) applying a first layer of binder over the previously spread layer of rubber particles, with the binder having a viscosity to at least partially permeate through the previously spread layer of rubber particles;

(c) then, after the first layer of binder has been applied to the previously spread layer of rubber particles, applying a second layer of binder over the first layer of binder; and (d) spreading a layer of rubber particles on the preceding layers immediately after the second layer of binder is applied so that at least some of the rubber particles in the layer bond to the preceding layers as the second layer of binder dries.

2. A method as claimed in claim 1; and (e) repeating steps (b), (c) and (d) until a desired mat thickness is created.

3. A method as claimed in claim 1; and (e) applying a final layer of binder over the uppermost layer of rubber particles.

4. A method as claimed in claim 3; and (g) applying a protective coating over the final layer of binder.

5. A method as claimed in claim 1, steps (b) and (c) each including the step of manually spraying the binder on the preceding layer.

6. A method as claimed in claim 1, step (a) including the step of cleaning the base surface before the layer of rubber particles is spread onto the surface.

7. A method as claimed in claim 1, step (a) including the step of moving a particle spreader over the base surface.

8. A method as claimed in claim 7, step (a) including the step of configuring the spreader to spread rubber particles at a rate of approximately two pounds per square yard.

9. A method as claimed in claim 8, step (b) including the step of preparing the binder used in steps (b) and (c) by diluting a latex-based solution with water.

10. A method as claimed in claim 9, steps (b) and (c) each including the step of spraying the layer of binder on the preceding layer at a rate corresponding to approximately one-ninth gallon of undiluted latex-based solution per square yard.

11. A method as claimed in claim 1, step (b) including the steps of sectioning the previously spread layer of rubber particles into substantially equal areas, and spraying, in sequence, the first layer of binder on the areas.

12. A method as claimed in claim 11, step (c) including the step of spraying, in the same sequence as the first layer of binder, the second layer of binder on the areas.

13. A method as claimed in claim 12, step (d) including the step of spreading the layer of rubber particles on each area immediately after the second layer of binder has been sprayed on that area and before the second layer is sprayed on a subsequent area.

* * * * *